US008312833B2

(12) United States Patent
Chuang et al.

(10) Patent No.: US 8,312,833 B2
(45) Date of Patent: Nov. 20, 2012

(54) PNEUMATIC NOZZLE FOR ROLLER COATING

(75) Inventors: Cheng-Hsin Chuang, Yung-Kung (TW); Hsing-Sheng Wu, Kaohsiung (TW); Deng-Maw Lu, Yung-Kung (TW)

(73) Assignee: Southern Taiwan University of Technology, Tainan County (TW)

( * ) Notice: Subject to any disclaimer, the term of this patent is extended or adjusted under 35 U.S.C. 154(b) by 380 days.

(21) Appl. No.: 12/654,081

(22) Filed: Dec. 10, 2009

(65) Prior Publication Data

US 2011/0139066 A1 Jun. 16, 2011

(51) Int. Cl.
*B05C 5/02* (2006.01)
*B05C 11/06* (2006.01)

(52) U.S. Cl. ..... 118/62; 118/63; 118/320; 118/321; 118/323

(58) Field of Classification Search ..... 118/62, 118/63, 320, 321, 323; 427/348, 425, 427.3; 15/256.5, 93.1, 97.1
See application file for complete search history.

(56) References Cited

U.S. PATENT DOCUMENTS

| | | | | | |
|---|---|---|---|---|---|
| 3,247,004 | A | * | 4/1966 | Dosser | 427/104 |
| 5,582,868 | A | * | 12/1996 | Harada et al. | 427/287 |
| 5,755,883 | A | * | 5/1998 | Kinose et al. | 118/110 |
| 6,126,748 | A | * | 10/2000 | DeHart | 118/63 |
| 2006/0102036 | A1 | * | 5/2006 | Yoo et al. | 101/483 |
| 2008/0257258 | A1 | * | 10/2008 | Yajima et al. | 118/323 |

FOREIGN PATENT DOCUMENTS

| | | | |
|---|---|---|---|
| JP | 2001-150288 | * | 6/2001 |
| TW | 577360 | * | 2/2002 |

* cited by examiner

*Primary Examiner* — Laura Edwards
(74) *Attorney, Agent, or Firm* — Rosenberg, Klein & Lee

(57) ABSTRACT

A pneumatic nozzle for roller coating is revealed. A workpiece to be coated is fixed on a rotating power source of a machine. A high-pressure pneumatic nozzle and a material supply nozzle, both corresponding to the workpiece, are arranged at the machine. The workpiece is driven to rotate by the rotating power source while the material supply nozzle applies coating material to the workpiece and the high-pressure pneumatic nozzle releases high pressure gas. The coating material attached on the surface of the workpiece is pushed by the high pressure gas and spread uniformly on the workpiece by rotating workpiece. Thereby the material is coated smoothly in a non-contact way and the thickness of the coating material is controlled in micron scale. This helps following manufacturing of three-dimensional microstructures on rolls for producing roll dies and increases the practical value.

2 Claims, 4 Drawing Sheets

PNEUMATIC NOZZLE FOR ROLLER COATING

BACKGROUND OF THE INVENTION

1. Fields of the Invention

The present invention relates to a pneumatic nozzle for roller coating, especially to a pneumatic nozzle for roller coating that coats a coating material smoothly in a non-contact way and controls the thickness of the coating material in micron scale so as to manufacture three-dimensional microstructures on rollers for producing roller dies and increase the practical value.

2. Descriptions of Related Art

The most optimal manufacturing process of flexible electronics industry available now is the roll to roll process while how to coat a uniform film on a roll is a key technique in manufacturing of the molding die. The coating methods available now are as followings: slot die coating, roll to roll coating and doctor blade coating.

1. Refer to US Pat. App. No. 2006/0102036 A1, published on May 18, 2006, a method of coating a printing roll by slits is disclosed. By control of the amount of printing material flowing out of the printing device and the size of the slit, the thickness of the coating material is controlled. However, such way is not an optimal method for manufacturing of roll dies due to high technical requirements and high manufacturing cost.

2. Refer to Taiwanese Pat. App. No. 577360, published on Feb. 21, 2004-uniform coating device, the device includes a pressure member, a blade member and a coating member. The pressure member generates a pushing power source that pushes the blade member so as to control contact pressure between the blade member and the coating member. One end of the blade member is pushed by the pressure member while the other end is contacted with the coating member. By control of a force applied, the thickness of the film attached on surface of the coating member is controlled. The coating member contacted with the blade member can rotate so as to attach a chemical film on the surface thereof and then roll to process the chemical film for coating the film uniformly on the surface. However, in practice, this method is unable to produce films in micron (μm) scale and the uniformity is difficult to achieve.

3. Refer to U.S. Pat. No. 5,755,883, published on May 26, 1998, a roll coating device relating to a roll to roll coating is revealed. The coating device includes two rolls—a coating roll and a coating liquid transfer roll. After a coating liquid supplier supplying a predetermined amount of coating liquid on the coating liquid transfer roll, the coating liquid transfer roll rotates and an outer circumferential face of the coating liquid transfer roll contacts an elastic outer circumferential face of the coating roll so as to coat liquid. However, this method adjusts the thickness of the coating according to the distance between the two rolls. Thus the method has the same disadvantage as the Doctor Blade Coating method—it is unable to achieve production of films in micron scale is unable.

4. Refer to U.S. Pat. No. 5,582,868, published on Dec. 10, 1996, an intermittent coating process and an apparatus for coating of a sheet without wrinkling thereof is disclosed. The apparatus includes a plurality of rolls so as to prevent the occurrence of wrinkles or folds in the base sheet and improve accuracy of coating of the base sheet. Thus this method also can't control the thickness of the sheets precisely in micron scale. Moreover, selection of materials for rolls is quite important because certain kind of material is easily to cause wrinkles on the base sheet.

Thus there is a need to develop a pneumatic nozzle for coating roll that overcomes above shortcomings and has more practical value.

SUMMARY OF THE INVENTION

Therefore it is a primary object of the present invention to provide a pneumatic nozzle for roller coating that coats a coating material smoothly in a non-contact way and controls the thickness of the coating material in micron scale so as to manufacture three-dimensional microstructures on rollers for producing roller dies and increase the practical value.

In order to achieve above object, a roller coating device with pneumatic nozzle of the present invention consist of a rotating power source disposed on one side of a machine, a workpiece to be coated fixed on the rotating power source, a high-pressure pneumatic nozzle arranged at the other side of the machine and corresponding to the fixed workpiece, and a material supply nozzle corresponding to the fixed workpiece set on the machine. The material supply nozzle applies coating material and the high-pressure pneumatic nozzle sprays high pressure gas. The coating material attached on the surface of the workpiece is pushed by the high pressure gas from the high-pressure pneumatic nozzle and is coated uniformly on the surface of the workpiece due to rotation of the workpiece driven by the rotating power source.

Thereby the material is coated smoothly in a non-contact way and the thickness of the coating material is controlled in micron scale. This is beneficial to following manufacturing of three-dimensional microstructures on rollers for producing roller dies. The present invention has more practical value in applications.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
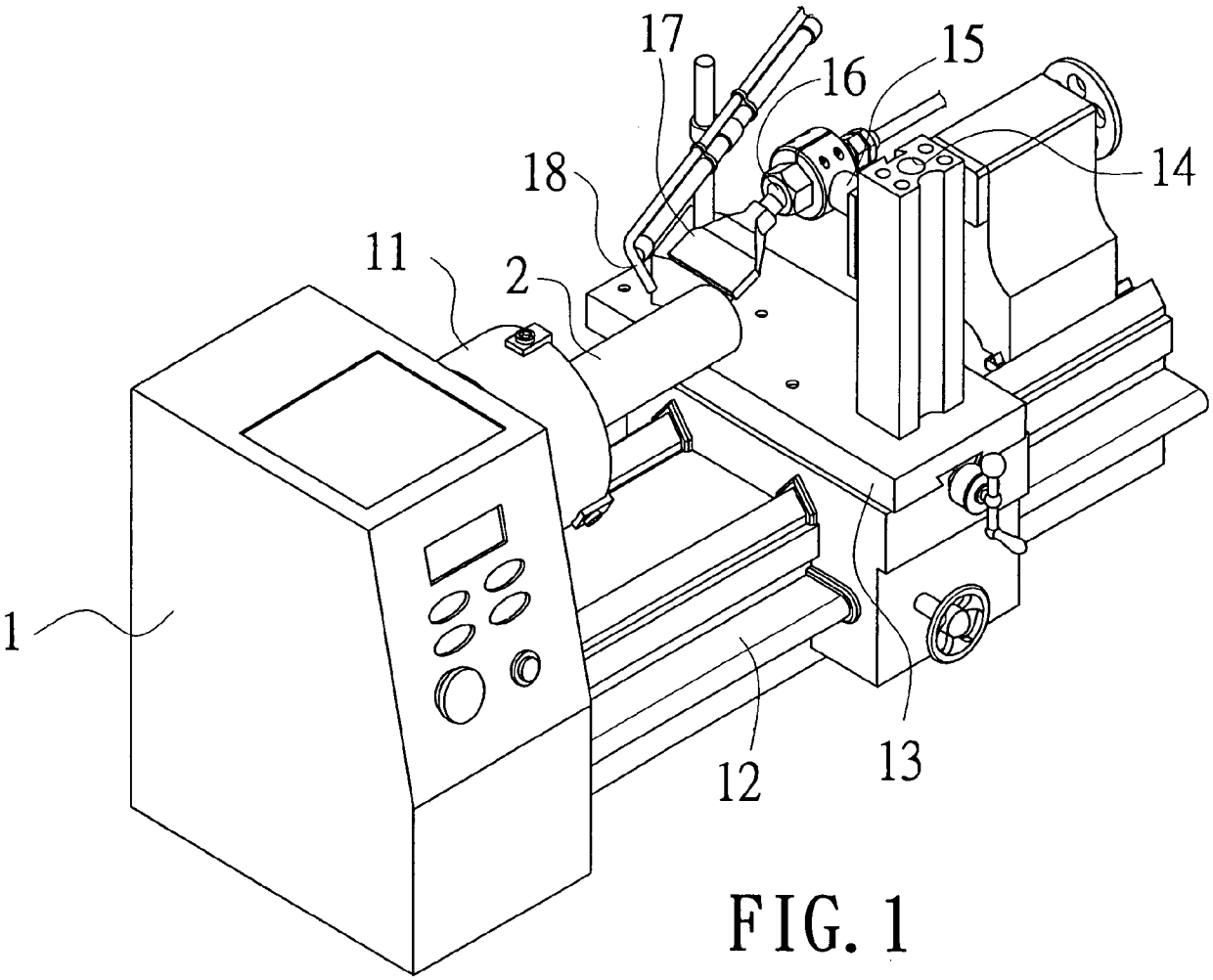
FIG. 1 is a perspective view of an embodiment according to the present invention.
Figure 2:
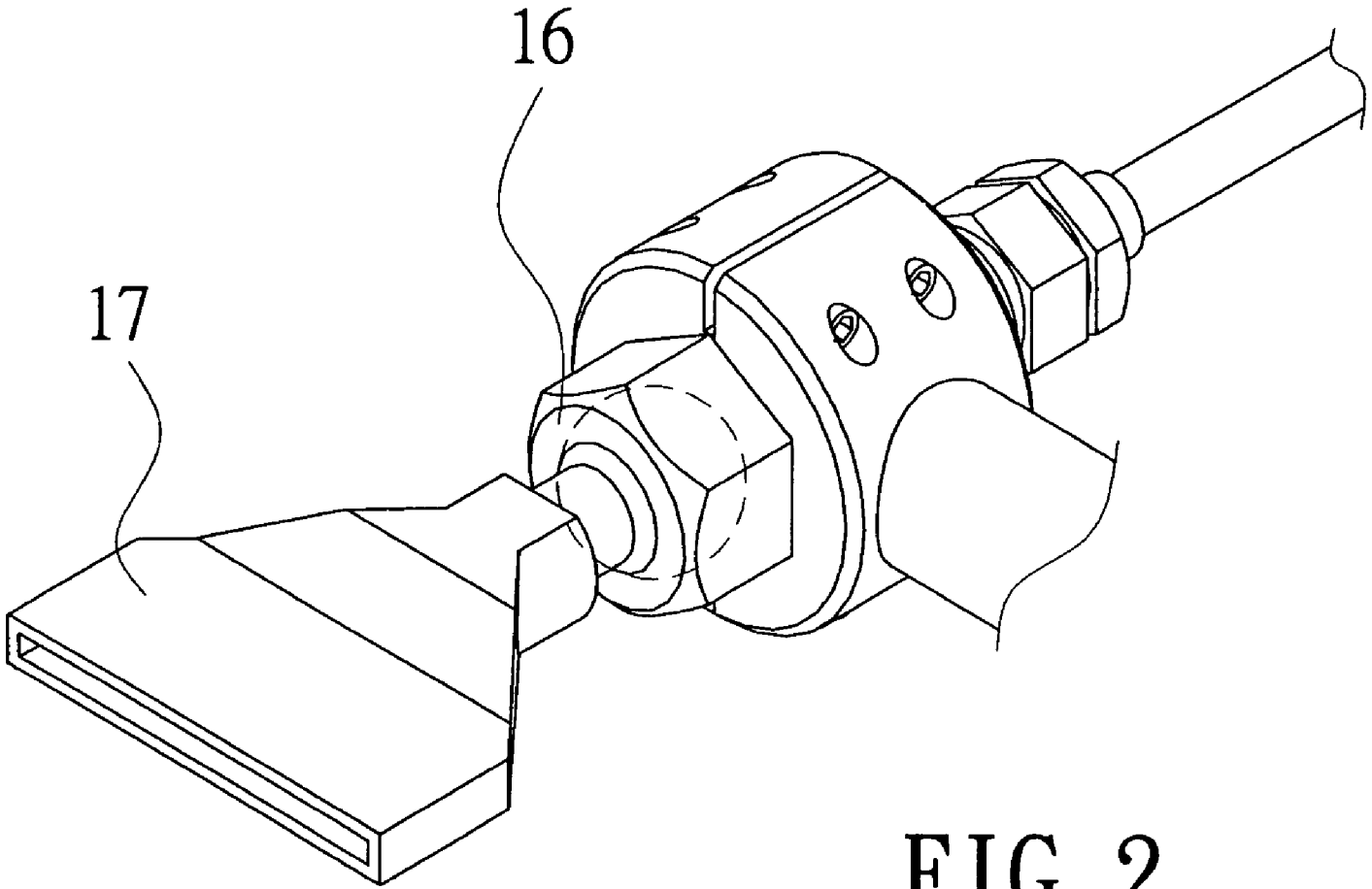
FIG. 2 is a partial enlarged view of an embodiment according to the present invention.

Refer to FIG. 1, a rotating power source 11 is disposed on one side of a machine 1 and a workpiece 2 to be coated is fixed and set on the rotating power source 11. A horizontal guide rail 12 is arranged at the other side of the machine 1 and a horizontal sliding seat 13 is disposed on the horizontal guide rail 12 while a vertical guide rail 14 is set on the horizontal sliding seat 13. A vertical sliding seat 15 is set on the vertical guide rail 14 and a universal joint 16 is disposed on the vertical sliding seat 15. The universal joint 16 is arranged with a high-pressure pneumatic nozzle 17 corresponding to the workpiece 2 fixed on the rotating power source 11, as shown in a partial enlarged view of FIG. 2. Moreover, a material supply nozzle 18 corresponding to the workpiece 2 fixed on the rotating power source 11 is disposed on the machine 1.

Figure 3:
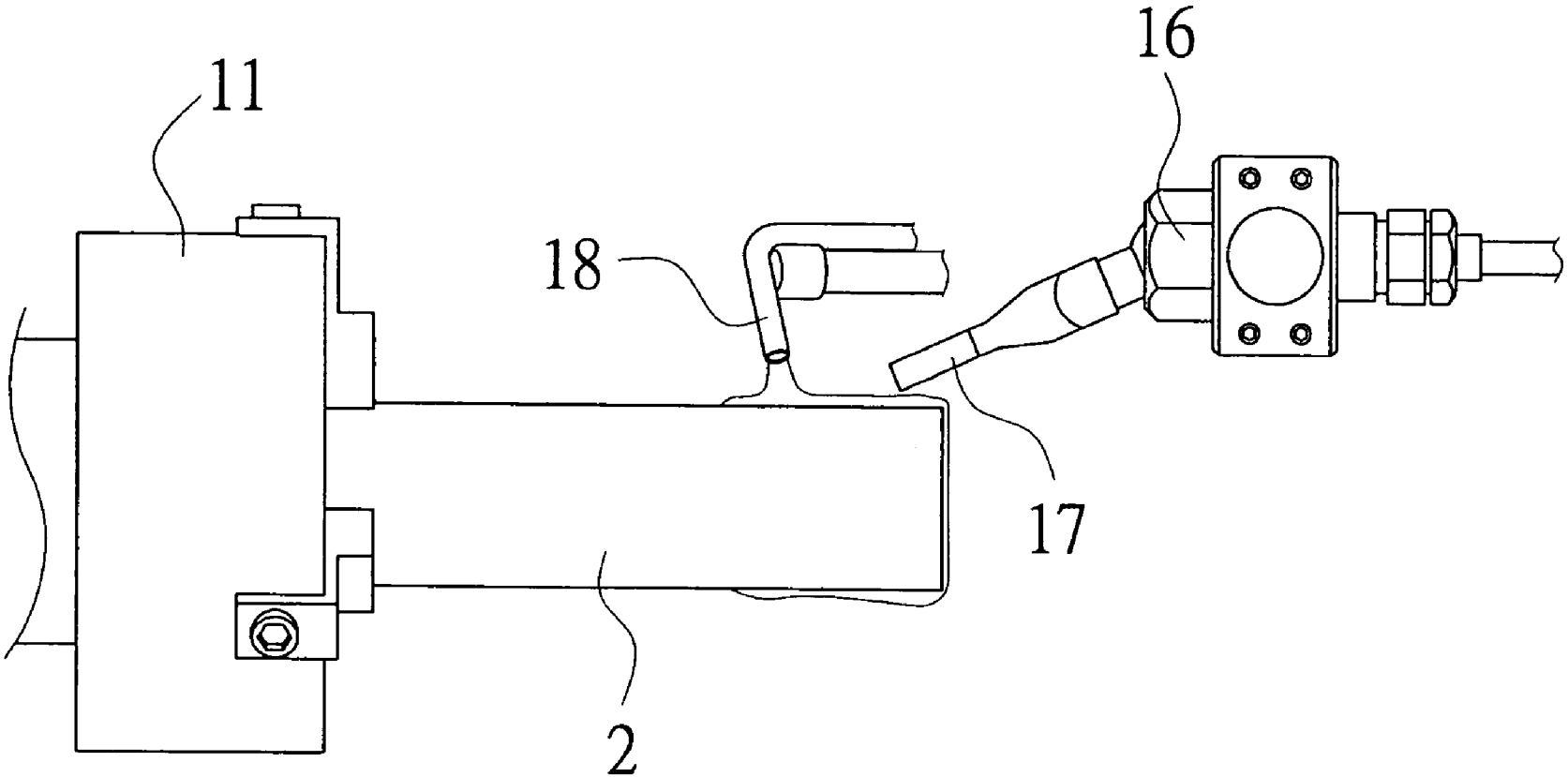
FIG. 3 is a schematic drawing showing an embodiment of the present invention in a use state.
Figure 4:
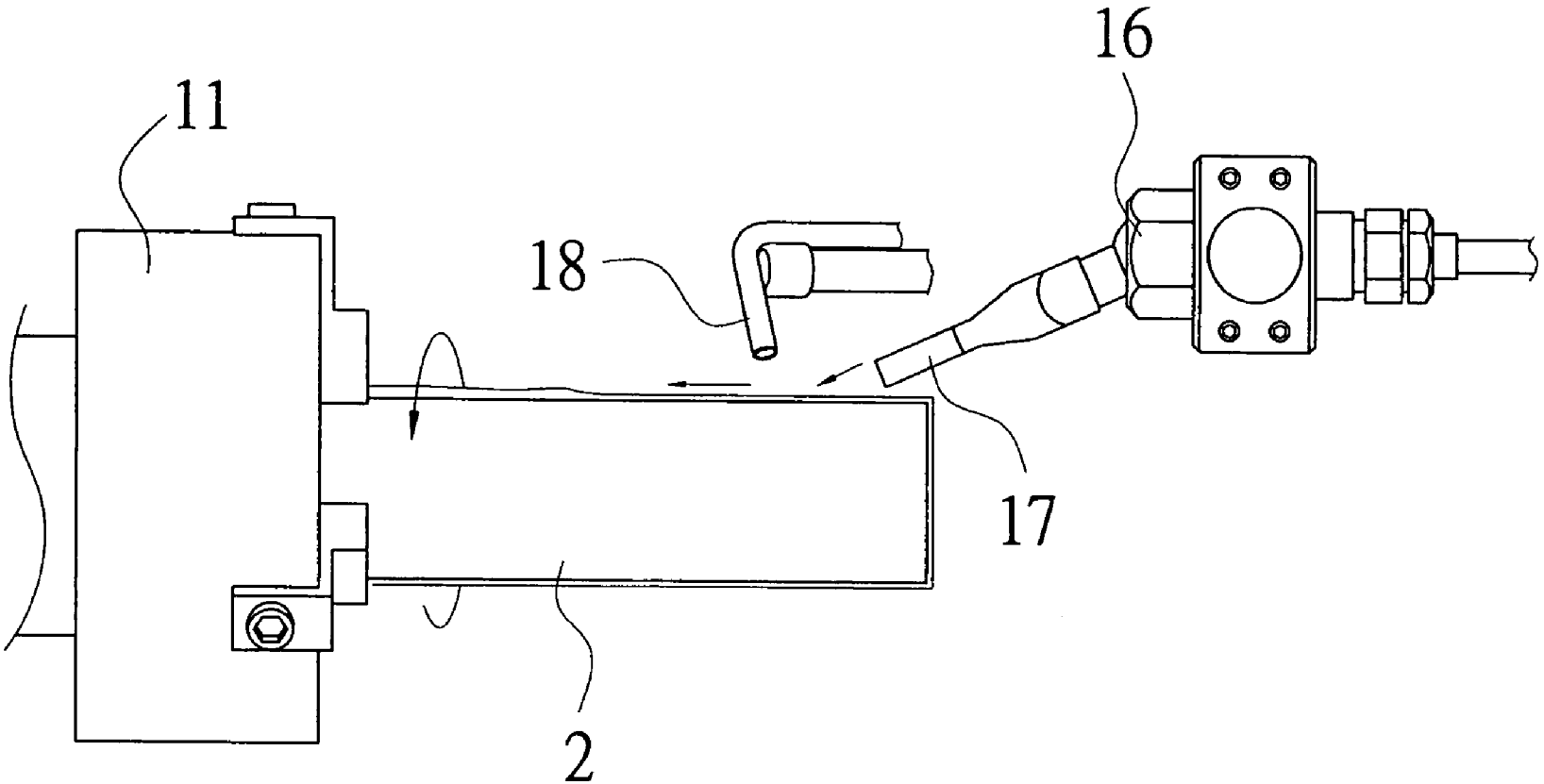
FIG. 4 is another schematic drawing showing an embodiment of the present invention in a use state.

Refer to FIG. 3, the horizontal position and the vertical position on the machine 1 are adjusted respectively by means of the horizontal sliding seat 13 on the horizontal guide rail 12 and the vertical sliding seat 15 on the vertical guide rail 14. Thus the high-pressure pneumatic nozzle 17 is adjusted and moved to the position corresponding to the workpiece 2 fixed on the rotating power source 11. Moreover, the positioned is further finely adjusted by the universal joint 16 between the vertical sliding seat 15 and the high-pressure pneumatic nozzle 17. After finishing the adjustment, the rotating power source 11 is controlled to drive the workpiece 2 to rotate and the material supply nozzle 18 applies coating material to the workpiece 2. At the same time, the high-pressure pneumatic nozzle 17 releases high pressure gas toward the workpiece 2 so as to make the high pressure gas push the coating material on the surface of the workpiece 2. By the rotating power source 11, the workpiece 2 is driven to rotate and this makes the coating material coat on the surface of the workpiece 2 more uniformly, as shown in a schematic drawing of FIG. 4.

In summary, compared with structure of devices available now, the present invention mainly drives the workpiece to rotate by control of the rotating power source of the machine. Moreover, the material supply nozzle sprays coating material to the workpiece and the high-pressure pneumatic nozzle applies high-pressure gas to the workpiece. Thus the coating material on the surface of the workpiece is pushed and by the high pressure gas from the high-pressure pneumatic nozzle. And the coating material is painted more uniformly further by rotation of the workpiece driven by the rotating power source. Thus the material is coated smoothly in a non-contact way. Furthermore, the thickness of the coating material is controlled in micron scale and this is beneficial to following manufacturing of three-dimensional microstructures on rollers for producing roller dies. In applications, the present invention has more practical value.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A pneumatic nozzle for roller coating, comprising:

a machine;

a rotating power source disposed on one side of the machine;

a workpiece to be coated arranged and fixed on the rotating power source;

a horizontal guide rail having a first end and a second end, the first end fixedly coupled to the machine;

a horizontal sliding seat displaceably coupled between the first and second ends of the horizontal guide rail;

a vertical guide rail having an end extending transversely from the horizontal sliding seat, the end of the vertical guide rail fixedly coupled to the horizontal sliding seat;

a vertical sliding seat is displaceably coupled to the vertical guide rail;

a high-pressure pneumatic nozzle disposed on the vertical sliding seat to proximally correspond to the workpiece fixed on the rotating power source for ejecting high pressure gas onto the workpiece providing a substantially smoothened coating of coating material on the workpiece; and a material supply nozzle corresponding to the workpiece fixed on the rotating power source and disposed on the machine;

wherein displacing the horizontal sliding seat along the horizontal guide rail concertly displaces the vertical guide rail, the vertical sliding seat and the high-pressure pneumatic nozzle.

2. The device as claimed in claim 1, wherein a universal joint is disposed between the high-pressure pneumatic nozzle and the vertical guide rail.

* * * * *